US011535809B2

(12) United States Patent
Argaud et al.

(10) Patent No.: US 11,535,809 B2
(45) Date of Patent: Dec. 27, 2022

(54) COMPRESSOR LUBRICANT COMPOSITION

(71) Applicant: TOTAL MARKETING SERVICES, Puteaux (FR)

(72) Inventors: Julien Argaud, Lyons (FR); Frédéric Michel, Genas (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 17/428,540

(22) PCT Filed: Feb. 3, 2020

(86) PCT No.: PCT/EP2020/052569
§ 371 (c)(1),
(2) Date: Aug. 4, 2021

(87) PCT Pub. No.: WO2020/161051
PCT Pub. Date: Aug. 13, 2020

(65) Prior Publication Data

US 2022/0127544 A1 Apr. 28, 2022

(30) Foreign Application Priority Data

Feb. 5, 2019 (FR) ..... 1901106

(51) Int. Cl.

| | |
|---|---|
| ***C10M 171/00*** | (2006.01) |
| *C10N 20/02* | (2006.01) |
| *C10N 30/06* | (2006.01) |
| *C10N 30/10* | (2006.01) |
| *C10N 40/30* | (2006.01) |

(52) U.S. Cl.
CPC .. *C10M 171/008* (2013.01); *C10M 2207/023* (2013.01); *C10M 2209/107* (2013.01); *C10M 2223/043* (2013.01); *C10N 2020/02* (2013.01); *C10N 2030/06* (2013.01); *C10N 2030/10* (2013.01); *C10N 2040/30* (2013.01)

(58) Field of Classification Search
CPC ..... C10M 171/008; C10M 2207/023; C10M 2209/107; C10M 2223/043; C10N 2020/02; C10N 2030/06; C10N 2030/10; C10N 2040/30
See application file for complete search history.

(56) References Cited

U.S. PATENT DOCUMENTS

| | | | | |
|---|---|---|---|---|
| 2009/0302264 | A1* | 12/2009 | Serrano | C09K 5/045 252/68 |
| 2010/0175421 | A1* | 7/2010 | Kaneko | C10M 107/34 62/468 |
| 2013/0096218 | A1* | 4/2013 | Rached | C09K 5/045 521/170 |
| 2013/0157909 | A1* | 6/2013 | Greaves | C10M 105/14 508/513 |
| 2017/0335232 | A1 | 11/2017 | Kaneko | |
| 2019/0225906 | A1* | 7/2019 | Koban | C10M 107/34 |
| 2019/0292477 | A1* | 9/2019 | Goyal | C10M 107/34 |
| 2020/0017792 | A1* | 1/2020 | Sherman | C10M 169/041 |
| 2022/0064093 | A1* | 3/2022 | Nakajima | C10M 169/04 |
| 2022/0081513 | A1* | 3/2022 | Nakajima | C10M 169/04 |

FOREIGN PATENT DOCUMENTS

| | | | |
|---|---|---|---|
| EP | 0421765 | A1 | 4/1991 |
| EP | 2161323 | A1 | 3/2010 |
| WO | 89/03866 | A1 | 5/1989 |
| WO | 2010/075046 | A2 | 7/2010 |

OTHER PUBLICATIONS

Translation of the International Search Report for counterpart Application No. PCT/EP2020/052569, dated Mar. 31, 2020.

* cited by examiner

*Primary Examiner* — Ellen M McAvoy
(74) *Attorney, Agent, or Firm* — The Marbury Law Group, PLLC

(57) ABSTRACT

The present invention relates to a lubricating composition, intended for a refrigerant system comprising a gas compression circuit, comprising:
at least one first polyalkylene glycol exhibiting a hydroxyl number strictly of greater than 50 mg KOH/g and a kinematic viscosity, measured at 100° C. according to the standard ASTM D445, ranging from 5 to 10 $mm^2/s$, and
at least one second polyalkylene glycol with a kinematic viscosity, measured at 100° C., ranging from 100 to 500 $mm^2/s$,
said polyalkylene glycols A and B being present in a PAG(s) A/PAG(s) B ratio by weight of between 60/40 and 99/1.
It also relates to the employment of such a lubricating composition in a refrigerant system comprising a gas compression circuit, in particular for an automobile air conditioning system, in combination with a coolant based on hydrocarbon compounds, such as R134a and/or HFO-1234yf.

20 Claims, No Drawings

COMPRESSOR LUBRICANT COMPOSITION

CROSS REFERENCE TO RELATED APPLICATION

This is a national stage application of PCT/EP2020/052569, filed internationally on Feb. 3, 2020, which claims priority to French Application No. 1901106, filed on Feb. 5, 2019, both of which are incorporated by reference herein in their entireties.

TECHNICAL FIELD

The present invention relates to a lubricating composition, intended for refrigerant systems comprising a gas compression circuit, and more particularly for compressors of automobile air conditioning systems, which operate in the presence of hydrofluorocarbon refrigerants, in particular based on 1,1,1,2-tetrafluoroethane (R134a) and/or on 2,3,3,3-tetrafluoropropene (HFO-1234yf).

PRIOR ART

In general, an air conditioning system intended to cool the passenger compartment of a motor vehicle comprises an evaporator, a compressor, a condenser, an expansion valve and a heat-transfer fluid, called a refrigerant or coolant.

Such an air conditioning device is based on a thermodynamic cycle comprising the evaporation of the refrigerant at low pressure (in which the fluid absorbs heat); the compression of the evaporated refrigerant up to a high pressure, the condensation of the evaporated refrigerant to give liquid at high pressure (in which the fluid discharges heat), and the expansion of the refrigerant to complete the cycle.

The choice of refrigerant is dictated by its thermodynamic properties, but also by its impact on the environment, in particular on global warming. Thus, chlorinated compounds, for example of chlorofluorocarbon and hydrochlorofluorocarbon type, which exhibit the disadvantage of damaging the ozone layer, have been gradually replaced by non-chlorinated compounds, such as hydrofluorocarbons, fluoroethers and fluoroolefins.

The coolant most commonly used at present in automobile air conditioning systems is 1,1,1,2-tetrafluoroethane, denoted under the name "R134a". More recently, a new coolant, exhibiting a reduced global warming potential (GWP), 2,3,3,3-tetrafluoropropene, denoted under the name "HFO-1234yf", has been developed, and is now recommended in Europe due to its low GWP and its good energy performance qualities.

Moreover, in order to lubricate the moving parts of the compressor(s) of a refrigerant system, such as an air conditioning device, a lubricating oil must be added in the automobile air conditioning device, in particular in the compressor. The oil can generally be mineral or synthetic.

The lubricating oil used in the automobile air conditioning compressor is brought into contact with the coolant in gaseous form, which imposes constraints of miscibility, of compatibility and of chemical stability of the coolant with the lubricating oil.

More particularly, the lubricating oil must be chosen so as not to react with the refrigerant or to negatively impact the properties of the latter. Thus, it is essential for the lubricating oil to be compatible with the refrigerant used. In particular, it must be chemically and thermally stable in the presence of the refrigerant.

Also, it is desirable for the coolant to exhibit good properties of miscibility with the lubricating oil, in other words for the mixture of the coolant with the lubricating oil not to undergo phase separation during its use in the air conditioning system, that is to say in a wide temperature range, preferably ranging from −10° C., in particular from −20° C., up to 10° C., preferably up to 30° C.

In fact, poor miscibility of the coolant with the lubricating oil can negatively impact the lifetime and the efficiency of the air conditioning system. For example, when the coolant exhibits poor miscibility with the lubricating oil, the latter tends to be trapped in the evaporator and to not return to the compressor, which does not make possible sufficient lubrication of the parts of the compressor.

Unfortunately, coolants based on hydrofluorocarbon compounds, such as R134a and/or HFO-1234yf, exhibit a miscibility with the lubricating oils ordinarily employed in air conditioning systems which is often imperfect.

Consequently, it is important to formulate a lubricating oil, which exhibits good properties in terms of chemical and thermal stability, of compatibility and of miscibility with coolants based on hydrofluorocarbon compound(s), in particular with R134a and/or HFO-1234yf.

To this end, the document EP 2 161 323 on behalf of Idemitsu provides, for example, lubricating formulations, compatible with unsaturated fluorinated hydrocarbon coolants, such as 1,2,3,3,3-pentafluoropropene, based on polyoxyalkylene glycols, the two hydroxyl ends of which are capped (double end capped), exhibiting a hydroxyl number of less than or equal to 5 mg KOH/g. Such polyoxyalkylene glycols are more particularly chosen from polypropylene glycol dimethyl ether, polyethylene/polypropylene glycol dimethyl ether, polyethylenelpolypropylene glycol methyl butyl ether and polypropylene glycol diacetate.

Mention may also be made of the document EP 2 367 915, on behalf of Shrieve Chemical Products, which provides lubricating oils compatible with the coolant HFO-1234yf, based on "double end capped" polyalkylene glycols, of formula $RX(R^bO)_yR^c$, with R representing a $C_{14}$ substituent comprising a heterocycle and $R^c$ representing a $C_3$ alkyl group.

SUMMARY OF THE INVENTION

The present invention is targeted specifically at providing a novel lubricating composition, intended for a system for transfer of heat by compression of gas, in particular for an air conditioning compressor, employing a coolant based on fluorocarbon compound(s), in particular of R134a and/or HFO-1234yf type.

More precisely, the inventors have discovered that it is possible to access a lubricating composition, meeting the above mentioned requirements for lubricants for refrigerant systems, by employing, as base oil, a mixture of at least two specific polyalkylene glycols.

Thus, the present invention relates, according to a first of its aspects, to a lubricating composition, intended for a refrigerant system comprising a gas compression circuit, in particular for a compressor of an automobile air conditioning system, comprising:

at least one first polyalkylene glycol, denoted PAG A, exhibiting a hydroxyl number strictly of greater than 50 mg KOH/g and a kinematic viscosity, measured at 100° C. according to the standard ASTM D445, ranging from 5 to 10 $mm^2/s$ and at least one second polyalkylene glycol, denoted PAG B, with a kinematic viscosity, measured at 100° C. according to the standard ASTM D445, ranging from 100 to 500 $mm^2/s$, said polyalkylene glycols A and B being present in a PAG(s) A/PAG(s) B ratio by weight of between 60/40 and 99/1.

The invention also relates, according to another of its aspects, to the use of a lubricating composition, as defined above, in a refrigerant system comprising a gas compression circuit, in particular in a compressor of an automobile air conditioning system, in combination with a coolant based on hydrofluorocarbon compounds, in particular with a coolant based on R134a and/or HFO-1234yf.

A lubricating composition according to the invention can additionally comprise one or more additives, in particular chosen from antiwear and extreme pressure additives, antioxidants, lubricity agents, acid scavengers and antifoaming agents.

As described in detail in the continuation of the text, according to a particularly preferred embodiment, a lubricating composition according to the invention additionally comprises at least one phenolic antioxidant additive.

Preferably, a lubricating composition according to the invention additionally comprises at least one antiwear additive of amine phosphate type.

The hydroxyl number (OH number) represents the amounts of potassium hydroxide in mg corresponding to the number of hydroxyl groups present in 1 g of material. The hydroxyl timber is representative of the fractionalization or not of the hydroxyl ends of the polyalkylene glycol employed. More particularly, the polyalkylene glycols of PAG A type employed according to the invention, exhibiting a hydroxyl number strictly of greater than 50 mg KOH/g, are typically polyalkylene glycols exhibiting a single capped hydroxyl end, more generally designated under the name "single end capped". In other words, the polyalkylene glycols A according to the invention exhibit at least one free hydroxyl end, The use of polyalkylene glycols of "single end capped" type as predominant base oil in a lubricating formulation intended for a refrigerant system was not at all obvious. In fact, the polyalkylene glycols exhibiting both ends capped, in other words not exhibiting a free hydroxyl functional group ("double end capped"), are usually preferred to the "single end capped" polyalkylene glycols, because of their thermal stability.

Against all expectations, the inventors have shown that it is possible, by combining two distinct polyalkylene glycols, preferably employed in combination with specific additives, in particular with at least one phenolic antioxidant and at least one antiwear additive of amine phosphate type, to obtain a lubricating formulation fully meeting the lubrication constraints of refrigerant systems, such as air conditioning compressors, employing coolants of the R134a and/or HFO-1234yf type.

Thus, advantageously, a lubricating composition according to the invention, comprising a base oil formed predominantly of the mixture of the two polyalkylene glycols A and B as are defined above, exhibits excellent miscibility with a coolant based on hydrofluorocarbon heat-transfer compounds, in particular with a coolant based on R134a and/or HFO-1234yf, over a wide temperature range. These miscibility properties can be tested according to the standard DIN 51514.

Also, a lubricating composition according to the invention advantageously exhibits excellent properties in terms of thermal and chemical stability, in the presence of a refrigerant based on hydrofluorocarbon compounds, in particular based on R134a and/or HFO-1234yf.

Advantageously, the development of a lubricating formula according to the invention, exhibiting good thermal stability and good miscibility with coolants based on R134a and/or HFO-1234yf, makes it possible to replace the coolants used up to now in automobile air conditioning devices, such as 1,1-difluoroethane, without impacting the lubrication of the parts of the compressor and the efficiency of the refrigerant system.

Finally, as the polyalkylene glycols exhibiting a single capped end have a lower cost than polyalkylene glycols exhibiting two capped ends, the lubricating formulation according to the invention, in which the first polyalkylene glycol(s). PAG A, constitute the predominant base oil, proves to be particularly advantageous in terms of cost price.

Furthermore, the lubricating composition according to the invention exhibits satisfactory tribological properties which are particularly suitable for its use for the lubrication of a compressor of an automobile air conditioning system. In particular, the lubricating composition according to the invention exhibits a good lubricity, a low pour point and a good low-temperature fluidity.

Preferably, it exhibits a kinematic viscosity, measured at 40° C., (KV/40), according to the standard ASTM D445 (ISO 3104), of between 30 and 60 mm/s, in particular between 30 and 55 $mm^2/s$ and more particularly between 40 and 50 $mm^2/s$.

The invention also relates, according to another of its aspects, to a heat-transfer composition for a refrigerant system comprising a gas compression circuit, in particular for an automobile air conditioning system, comprising:

a lubricating composition as defined above: and a coolant based on hydrofluorocarbon compounds, in particular based on 1,1,1,2-tetrafluoroethane (R134a) and/or 2,3,3,3-tetrafluoropropene (HFO-1234yf).

In particular, the coolant considered according to the invention can consist of R134a, HFO-1234yf or a mixture of R134a and HFO-1234yf.

The term "heat-transfer compound", respectively "heat-transfer fluid", also called "coolant" or "refrigerant", is understood to denote a compound, respectively a fluid, capable of absorbing heat by evaporating at low temperature and at low pressure, and of discharging heat by condensing at high temperature and high pressure, in a gas compression circuit. Generally, a heat-transfer fluid can comprise one, two, three or more heat-transfer compounds.

According to a specific embodiment, the coolant comprises only R134a as heat-transfer compound.

According to another specific embodiment, the coolant comprises only HFO-1234yf as heat-transfer compound.

According to another alternative embodiment, it is a mixture of R134a and HFO-1234yf.

The invention is also targeted at the use of a heat-transfer composition as defined above in a refrigerant system comprising a gas compression circuit, in particular for an automobile air conditioning system.

It also relates to a refrigerant system comprising a gas compression circuit, in particular an automobile air conditioning system, comprising a heat-transfer composition as defined above.

The invention also relates, according to another of its aspects, to a kit intended to be employed for a refrigerant system comprising a gas compression circuit, comprising:

a lubricating composition as defined above; and a coolant based on hydrofluorocarbon compounds, in particular based on 1,1,1,2-tetrafluoroethane (R134a) and/or 2,3,3,3-tetrafluoropropene HFO-1234yf).

The kit can be more particularly intended for an automobile air conditioning unit.

Other characteristics, alternative forms and advantages of the lubricating compositions according to the invention will emerge more clearly on reading the description and the examples which will follow, given by way of illustration and without limitation of the invention.

In the continuation of the text, the expressions "of between . . . and . . . ", "ranging from . . . to . . . " and "varying from . . . to . . . " are equivalent and are understood to mean that the limits are included, unless otherwise mentioned.

Unless otherwise indicated, the expression "comprising a" or "comprising an" should be understood as "comprising at least one".

DETAILED DESCRIPTION

Lubricating Composition

As indicated above, a lubricating composition according to the invention, intended for a refrigerant system, in particular for an automobile air conditioning system, comprises a base oil formed predominantly of a mixture of at least two distinct polyalkylene glycols, denoted PAG A and PAG B, in particular as are defined below, Polyalkylene Glycol A In the continuation of the text, the term "PAG A" denotes the polyalkylene glycols) employed in a lubricating composition according to the invention, meeting the criteria defined above for the first polyalkylene glycol according to the invention.

In particular, the term "PAG A" is understood to mean in particular a single PAG A or a mixture of two or more PAGs A.

The PAG A according to the invention exhibits a hydroxyl number strictly of greater than 50 mg KOH/g, in particular ranging from 52 to 75 mg KOH/g and more particularly from 55 to 70 mg KOH/g.

The hydroxyl number can be measured according to the standard ASTM E1899-08.

The PAG A according to the invention is more particularly a polyalkylene glycol exhibiting just one of its hydroxyl ends capped by a group ("single end capped"). In other words, it exhibits at least one free hydroxyl end.

The PAG A according to the invention is thus distinguished from "double end capped" polyalkylene glycols exhibiting the two hydroxyl ends capped.

The hydroxyl group can, for example, be capped with an alkyl group containing from 1 to 10 carbon atoms, in particular from 1 to 5 carbon atoms, optionally comprising one or more heteroatoms, such as nitrogen atoms, or else with a fluoroalkyl group optionally containing heteroatoms, such as nitrogen. The terminal hydroxyl group can also be capped by forming an ester with a carboxylic acid. The carboxylic acid can also be fluorinated.

Preferably, the terminal group of a PAG A according to the invention is chosen from alkyl groups having between 1 and 5 carbon atoms, preferably between 1 and 4 carbon atoms, such as a methyl or butyl group.

Furthermore, the PAG A employed according to the invention exhibits a kinematic viscosity, measured at 100° C. (KV100), measured according to the standard ASTM 0445, ranging from 5 to 10 $mm^2/s$.

Preferably, it exhibits a kinematic viscosity, measured at 100° C. according to the standard ASTM D445, of between 6 and 9 $mm^2/s$.

The PAG A according to the invention can be formed of oxyalkylene units each containing from 1 to $ carbon atoms, preferably from 2 to 4 carbon atoms. It can be a homopolymer or a copolymer of 2, 3 or more than 3 groups chosen from oxyethylene, oxypropylene, oxybutylene or oxypentylene groups and the combinations of these.

Preferably, the PAG A comprises at least oxypropylene units.

More particularly, it is preferably formed of at least 50% by weight of oxypropylene (OP) units, in particular of at least 75% by weight of oxypropylene units, indeed even of at least 95% by weight of oxypropylene units.

According to a particularly preferred embodiment, the PAG A is a copolymer of propylene oxide and of ethylene oxide.

It is preferably a copolymer of propylene oxide and of ethylene oxide, exhibiting an oxypropylene (OP) units/oxyethylene (OE) units ratio by weight of greater than or equal to 1:1, in particular of between 2:1 and 10:1.

The PAG A employed according to the invention can be prepared by polymerization or copolymerization of alkylene oxides comprising from 1 to 8 carbon atoms, in particular from 2 to 4 carbon atoms.

The synthesis of a PAG A according to the invention more particularly employs an initiator of monovalent alcohol type having from 1 to 10 carbon atoms, in particular methanol or butanol, in order to obtain a polyoxyalkylene glycol exhibiting an ether group at one of its ends and a free hydroxyl end.

A person skilled in the art is able to adjust the operating conditions for the synthesis of the polyalkylene glycol, in order to obtain the desired "single end capped" PAG, in particular exhibiting a hydroxyl number as defined above.

Preferably, a PAG A according to the invention exhibits a weight-average molecular weight ranging from 300 to 2000 g/mol, in particular of between 800 and 1500 g/mol.

The weight-average molecular weight can be measured by gel permeation chromatography (GPC).

The flash point of the PAG A is preferably greater than or equal to 160° C., in particular greater than or equal to 190° C.

The flash point can be measured by the standard ISO 2592.

Preferably, the PAG A employed to form a lubricating composition according to the invention exhibits a water content of less than or equal to 700 ppm by weight.

PAGs A which meet the abovementioned criteria and which can be employed in a lubricating composition according to the invention may be commercially available, for example the oils sold under the Konlube® 240 YF, RF 232 YF and GEOlube PAG A 01930 references.

The oil sold under the Konlube® RF 232 YF reference is particularly appropriate.

The polyalkylene glycol(s) A can be employed in a proportion of 60% to 99% by weight, with respect to the total weight of the lubricating composition, in particular of 70% to 99% by weight and more preferentially of 80% to 98% by weight, more preferentially still of 85% to 95% by weight.

The poly alkylene glycol(s) A according to the invention preferably represent more than 70% by weight, in particular more than 75% by weight, of the total weight of the base oils present in the lubricating composition according to the invention.

Polyalkylene Glycol(s) B

Just as for the polyalkylene glycol(s) A, the term "PAG B" is understood to mean one or more polyalkylene glycols employed in a lubricating composition according to the invention, meeting the criteria defined above for the second polyalkylene glycol according to the invention.

The PAG B employed according to the invention is distinguished from a PAG A as described above, in particular in that it exhibits a higher kinematic viscosity KV100 than that of a PAG A.

In particular, the PAG B exhibits a kinematic viscosity, measured at 100° C. (KV100) according to the standard ASTM D445, of greater than or equal to 100 $mm^2/s$ and less than or equal to 500 $mm^2/s$.

Preferably, the kinematic viscosity KV100 of a PAG B employed according to the invention is between 120 and 300 $mm^2/s$ and more particularly between 140 and 200 $mm^2/s$, indeed even between 150 and 190 $mm^2/s$.

The PAG B employed according to the invention is more particularly obtained by polymerization or copolymerization of alkylene oxides comprising from 1 to 8 carbon atoms, in particular from 2 to 4 carbon atoms.

Preferably, the PAG B comprises 50% or less than 50% by weight of oxypropylene units.

Preferably, it is a copolymer of propylene oxide and of ethylene oxide, in particular formed of at least 50% by weight of oxyethylene units, and more particularly exhibiting an oxypropylene (OP) units/oxyethylene (OE) units ratio by weight ranging from 2:8 to 1:1, in particular from 4:6 to 1:1.

The PAG B can exhibit a single ("single end capped") or two ("double end capped") capped hydroxyl ends.

As described above, the hydroxyl group can be capped with an alkyl group containing from 1 to 10 carbon atoms, optionally comprising one or more heteroatoms, such as nitrogen atoms, or a fluoroalkyl group containing heteroatoms, such as nitrogen.

According to a specific embodiment, the PAG B is a "double end capped" polyalkylene glycol.

When the two hydroxyl ends of the polyalkylene glycol are capped, the same end group or a combination of two distinct groups can be used.

The PAG B can be synthesized according to methods known to a person skilled in the art. Preferably, it can be obtained by polymerization starting from an initiator of diol or other type.

Preferably, a PAG B according to the invention exhibits a weight-average molecular weight $M_w$ of greater than or equal to 4000 g/mol, in particular of greater than or equal to 5000 g/mol and more particularly of between 5000 and 15 000 g/mol.

The flash point of the PAG B is preferably greater than or equal to 200° C.

PAGs B which meet the abovementioned criteria and which can be employed in a lubricating composition according to the invention may be commercially available. Mention may be made, for example, of the oils sold under the Synalox® 40D700, Breox® 50A1000, Breox® 60W1000 and Emkarox® VG 1050W references.

The oil sold under the Synalox® 40D700 reference is particularly appropriate.

The polyalkylene glycol(s) B can be employed in a proportion of 1% to 30% by weight, with respect to the total weight of the lubricating composition, in particular of 1% to 15% by weight and more preferentially of 3% to 10% by weight.

The polyalkylenes A and B exhibit excellent properties of miscibility with one another.

Preferably, the polyalkylene glycols A and B are employed in a lubricating composition according to the invention in a PAG A1PAG B ratio by weight ranging from 60/10 to 99/1, in particular from 70/30 to 98/2 and more preferentially from 85/15 to 95/5.

The lubricating composition according to the invention can optionally comprise one or more additional base oils, in minor amounts in comparison with the PAGs A and B.

Thus, preferably, the mixture of the polyalkylene glycols A and B represents more than 95% by weight, in particular more than 98% by weight, of the total weight of the base oils of a lubricating composition.

According to a particularly preferred embodiment, a lubricating composition according to the invention is devoid of base oil other than said polyalkylene glycols A and B according to the invention.

Lubricating Composition

According to a particularly preferred embodiment, the mixture of said polyalkylene glycols A and B represents more than 70% by weight, especially more than 80% by weight, in particular more than 90% and especially more than 95% by weight, of the total weight of the lubricating composition according to the invention.

A lubricating composition employed according to the invention can comprise, besides said polyalkylene glycols A and B according to the invention, one or more additives.

The additives can in particular be chosen from anti wear and extreme pressure additives, lubricity agents, antioxidants, acidity scavengers and antifoaming agents.

Anti Wear/Extreme Pressure Additives

Advantageously, a lubricating composition according to the invention comprises at least one antiwear or extreme pressure additive.

Mention may be made, as antiwear and extreme pressure additives, of agents based on phosphorus, such as phosphates, phosphoric acids, phosphites, acid phosphites and their amine salts.

Mention may in particular be made, among extreme pressure and antiwear additives based on phosphorus, of phosphate esters, such as tricresyl phosphate or trithiophenyl phosphate, tris(nonylphenyl) phosphite, dioleyl hydrogen phosphite, 2-ethylhexyl diphenyl phosphite, and the like.

The extreme pressure additives can also be carboxylic acid metal salts, in particular metal salts of carboxylic acids having from 3 to 60 carbon atoms, in particular from 3 to 30 carbon atoms and more particularly from 12 to 30 carbon atoms. They can also be metal salts of dimers and trimers of aliphatic acids, and of dicarboxylic acids having from 3 to 30 carbon atoms.

The metal salt can more particular v be an alkali metal or alkaline earth metal salt, in particular an alkali metal salt.

Other extreme pressure additives can also be envisaged, such as extreme pressure additives based on sulfur, such as, for example, sulfur-containing greases, sulfur-containing aliphatic acids, sulfur-containing esters, sulfur-containing olefins, dihydrocarvyl polysulfides, thiocarbamates, thioterpenes and dialkyl thiodipropionates.

According to a particularly preferred embodiment, the antiwear; extreme pressure additive is a phosphate-containing additive.

Preferably, the lubricating composition according to the invention comprises at least one antiwear/extreme pressure additive chosen from amine phosphates.

The amine phosphates can more particularly be $C_{10}$ to $C_{18}$ alkylamine phosphates of formula:

[Chem 1]

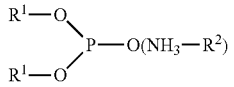

[Chem 2]

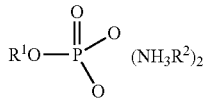

where $R^1$ is $C_1$ to $C_8$ alkyl and $R^2$ is $C_{10}$ to $C_{18}$ is alkyl.

Such amine phosphates are, for example, sold under the reference Vanlube® 672 by Vanderbilt or Irgodube® 349 by BASF.

The inventors have discovered that the use of an antiwear additive of amine phosphate type makes it possible, compared with other phosphorus-containing antiwear/extreme pressure additives, such as phosphate esters, to significantly improve the thermal stability of the lubricating composition in the presence of the coolant employed at a temperature of the order of 175° C.

The antiwear and extreme pressure additive(s), preferably of amine phosphate type, can be employed in a proportion of 0.001% to 3% by weight, with respect to the total weight of the composition, preferably of 0.005% to 1% by weight and more particularly of 0.05% to 0.5% by weight.

Antioxidant Additives

Advantageously, the lubricating composition according to the invention comprises at least one antioxidant additive.

The antioxidant additives can, for example, be phenolic antioxidant additives or amine-based antioxidant additives, such as phenyl-α-napththylamine or N, N'-diphenyl-p-phenylenediamine.

Preferably, the lubricating composition comprises at least one phenolic antioxidant additive.

The phenolic antioxidants can be more particularly chosen from 2,6-di(tert-butyl)phenol (as sold under the reference Irganox® 140 by Ciba-Geigy Corporation), 2,2'-methylenebis(4,6-di(tert-butyl)phenol), 1,6-hexamethylene bis(3,5-di(tert-butyl)-4-hydroxyhydrocinnamate) (as sold under the reference Irganox® L109 by Ciba-Geigy Corporation), the $C_{10}$-$C_{14}$ isoalkyl esters of (((3,5-bis(1,1-dimethylethyl)-4-hydroxyphenyl)methyl)thio)acetic acid (as sold under the reference Irganox® L118 by Ciba-Geigy Corporation), the $C_7$ to $C_9$ alkyl esters of 3,5-di(tert-butyl)-4-hydroxyhydrocinnamic acid (as sold under the reference Irganox® L135 by Ciba-Geigy Corporation), tetrakis(3-(3,5-di(tert-butyl)-4-hydroxyphenyl)propionyloxymethyl)methane (as sold under the reference Irganox® 1010 by Ciba-Geigy Corporation, thiodiethylene bis(3,5-di(tert-butyl)-4-hydroxyhydrocinnamate) (as sold under the reference Irganox® 1035 by Ciba-Geigy Corporation), octadecyl 3,5-di(tert-butyl)-4-hydroxyhydrocinnamate (for example sold under the reference Irganox® 1076 by Ciba-Geigy Corporation) and 2,5-di(tert-butyl)hydroquinone.

Preferably, the phenolic antioxidants are chosen from the $C_7$ to $C_9$ alkyl esters of 3,5-di(tert-butyl)-4-hydroxyhydrocinnamic acid, for example which are commercially available under the reference Irganox® L135 from Ciba-Geigy Corporation.

A lubricating composition according to the invention can comprise said antioxidant additive(s), preferably of phenolic type, in a proportion of 0.01% to 5% by weight, with respect to the total weight of said composition, preferably of 0.05% to 3% by weight and more particularly of 0.1% to 1% by weight.

According to a particularly preferred embodiment, a lubricating composition according to the invention thus comprises, besides said polyalkylene glycols A and B, in particular as described above:

at least one antiwear/extreme pressure additive of amine phosphate type; and/or at least one phenolic antioxidant, in particular of $C_7$ to $C_9$ alkyl ester of 3,5-di(tert-butyl)-4-hydroxyhydrocinnamic acid type.

In a particularly advantageous way, the inventors have found that the combined presence of at least one antiwear/extreme pressure additive of amine phosphate type and of at least one phenolic antioxidant, in addition to the combination of the polyalkylene glycols A and B according to the invention, makes it possible to optimize the thermal stability of the lubricating composition according to the invention. Such a composition advantageously exhibits a stable viscosity and an absence of chemical degradation (oxidation), at high temperatures of the order of 175° C.

Thus, according to a particularly preferred embodiment, the lubricating composition according to the invention comprises, indeed even consists of:

from 75% to 99% by weight of at least one polyalkylene glycol A as defined above;

from 1% to 15% by weight of at least one polyalkylene glycol B as defined above;

optionally from 0.001% to 1% by weight of at least one antiwear/extreme pressure additive of amine phosphate type; and optionally from 0.05% to 3% by weight of at least one phenolic antioxidant, the sum of the constituents being equal to 100%, and the percentages being expressed with respect to the total weight of the lubricating composition.

According to a specific embodiment, the lubricating composition according to the invention comprises, indeed even consists of:

from 75% to 98.5% by weight of at least one polyalkylene glycol A as defined above;

from 1% to 15% by weight of at least one polyalkylene glycol B as defined above; from 0.001% to 1% by weight of at least one antiwear/extreme pressure additive of amine phosphate type; and from 0.05% to 3% by weight of at least one phenolic antioxidant, the sum of the constituents being equal to 100%, and the percentages being expressed respect to the total weight of the lubricating composition.

Other additives can optionally be present in the lubricating composition according to the invention, In particular, it can comprise one or more lubricity additives, such as, for example, chosen from saturated and unsaturated aliphatic monocarboxylic acids, such as stearic acid and oleic acid, polymerized aliphatic acids, such as dimer acids and hydrogenated dimer acids, hydroxyaliphatic acids, such as ricinoleic acid and 12-hydroxystearic acid, saturated and unsaturated aliphatic monohydric alcohols, such as lauryl alcohol and oleyl alcohol, saturated and unsaturated aliphatic monoamines, such as stearylamine and oleylamine, saturated and unsaturated aliphatic monocarboxylic acid amides, such as lauric acid amide and oleic acid amide, and partial esters of polyhydric alcohols, such as glycerol and sorbitol, and saturated or unsaturated aliphatic monocarboxylic acids.

The lubricity additive(s) can be present in a proportion of 0.01% to 10% by weight, in particular of 0.1% to 5% by weight, with respect to the total weight of said composition.

According to a specific embodiment, a lubricating composition according to the invention can also comprise one or more "acid scavenger" compounds, such as, for example, chosen from glycidyl and phenyl ethers, alkyl and glycidyl ethers, alkylene glycol and glycidyl ethers, phenyl and glycidyl esters, alkenyl and glycidyl esters, cyclohexane oxide, α-olefin oxide and epoxy compounds, such as epoxidized soybean oil.

Preferably, the "acid scavenger" additives can be chosen from phenyl and glycidyl ethers, alkyl and glycidyl ethers, alkylene glycol and glycidyl ethers, glycidyl 2,2-dimethyloctanoate, glycidyl benzoate, glycidyl tert-butylbenzoate, glycidyl acrylate, glycidyl methacrylate, cyclohexane oxide and α-olefin oxide.

Each of the alkyl groups of the alkyl and glycidyl ether and the alkylene group of an alkylene glycol and glycidyl ether can be branched, and typically exhibits from 3 to 30 carbon atoms, preferably from 4 to 24 carbon atoms and more particularly from 6 to 16 carbon atoms. With regard to the α-olefin oxide, it can more particularly exhibit from 4 to 50 carbon atoms, in particular from 4 to 24 and more particularly from 6 to 16 carbon atoms.

Said "acid scavenger" compounds) can be present in a proportion of 0.005% to 5% by weight, in particular of 0.05% to 3% by weight, with respect to the total weight of said lubricating composition.

A lubricating composition according to the invention can also comprise one or more antifoaming additives, such as, for example, a silicone oil or a fluorinated silicone oil.

It is understood that other additives known to a person skilled in the art can also be present in a lubricating composition according to the invention, for example copper deactivators, such as N-[N,N'-dialkylaminomethyl]triazole.

Advantageously, a lubricating composition according to the invention exhibits a kinematic viscosity, measured at 40° C. (KV40), according to the standard ASTM D445 (ISO 3104), of between 30 and 60 $mm^2/s$, in particular between 35 and 60 $mm^2/s$ and more particularly between 40 and 50 $mm^2/s$.

The kinematic viscosity, measured at 100° C. (KV100), according to the standard ASTM D445 (ISO 3104), of a lubricating composition according to the invention can advantageously be between 5 and 10 $mm^2/s$, in particular between 8 and 10 $mm^2/s$.

Preferably, a lubricating composition according to the invention exhibits a. hydroxyl number strictly of greater than 40 mg KOH/g, in particular of between 45 and 70 mg KOH/g.

It preferably exhibits an acid number, measured according to the standard ISO 6618, of between 0.02 mg KOH/g and 0.2 mg KOH/g, preferably of less than 0.1 mg KOH/g.

Preferably, the water content of the lubricating composition according to the invention is strictly less than 700 ppm by weight.

Furthermore, it advantageously exhibits a flash point of strictly greater than 200° C.

Use in a Refrigerant System

As mentioned above, a lubricating composition according to the invention proves to be particularly suitable for its use in combination with a coolant, in a refrigerant system, in particular in an automobile air conditioning system.

The invention thus relates, according to another of its aspects, to a heat-transfer composition fix a refrigerant system comprising a gas compression circuit, in particular for an automobile air conditioning system, comprising:

a lubricating composition as defined above; and a coolant based on hydrofluorocarbon compounds, in particular based on 1,1,1,2-tetrafluoroethane (R 34a) and/or 2,3,3,3-tetrafluoropropene (HFO-1234yf).

It is also targeted at the use of such a heat-transfer composition in a refrigerant system comprising a gas compression circuit, such as a coolant gas.

The proportion of lubricating composition which has to be used in combination with the coolant depends on the type of unit concerned. This is because the total amount of lubricating oil in the unit depends mainly on the nature of the compressor, while the total amount of coolant in the unit depends mainly on the exchangers and the piping.

Generally, the proportion of coolant with respect to the lubricating composition is between 99/1 and 1/99, in particular between 95/5 and 5/95.

The coolant is more particularly based on heat-transfer compounds chosen from saturated or unsaturated hydrofluorocarbon compounds, and their mixtures.

The coolant can be binary (consisting of two heat-transfer compounds) or ternary (consisting of three heat-transfer compounds) or quaternary (consisting of four heat-transfer compounds).

The hydrofluorocarbon compounds correspond generally to the following formula (A):

$$[\text{Chem3}]C_pF_rH_s \quad (A)$$

in which:

p represents an integer between 2 and 6;

r represents an integer between 1 and 12; and s represents an integer between 0 and 11.

The unsaturated hydrofluorocarbon compounds can more particularly be chosen from pentafluoropropene isomers, in particular 3,3,3-trifluoropropene, 2,3,3,3-tetrafluoropropene, 1,2,3,3,3-pentafluoropropene and 2,3,3,3-tetrafluoropropene.

According to a specific embodiment, the coolant comprises, indeed even is formed of, 2,3,3,3-tetrafluoropropene (HFO-1234yf).

The saturated hydrofluorocarbon compounds can more particularly be chosen from fluorinated alkane compounds comprising from 1 to 4 carbon atoms, preferably fluorinated methane or ethane compounds, such as trifluoromethane, difluoromethane, 1,1-difluoroethane, 1,1,1-trifluoroethane, 1,1,2-trifluoroethane, 1,1,1,2-tetrafluoroethane, 1,1,2,2-tetrafluoroethane and 1,1,1,2,2-pentafluoroethane.

According to a specific embodiment, the coolant comprises, indeed even is formed of, 1,1,1,2-tetrafluoroethane (R134a).

The coolant considered according to the invention can also comprise one or more additional heat-transfer compounds, for example chosen from hydrocarbons, hydrofluorocarbons, ethers, hydrofluoroethers and fluoroolefins.

According to a particularly preferred alternative embodiment, the coolant is formed to more than 90% by weight, in particular to more than 95% by weight and more particularly to more than 99% by weight, of saturated and/or unsaturated hydrofluorocarbon compounds, in particular as defined above.

Preferably, the coolant is based on 1,1,1,2-tetrafluoroethane (R134a), on 2,3,3,3-tetrafluoropropene (HFO-1234yf) or on a mixture of R134a and HFO-1234yf.

In particular, the coolant considered according to the invention can consist of R134a, HFO-1234yf or a mixture of R134a and HFO-1234yf.

A lubricating composition according to the invention is more particularly intended to be employed, with a coolant based on R134a and/or HFO-1234yf, in a unit comprising a vapor compression circuit.

Typically, the vapor compression circuit comprises at least one evaporator, one compressor, one condenser and one expansion valve, as well as fluid transport lines between these elements. The evaporator and the condenser comprise a heat exchanger making possible an exchange of heat between the heat-transfer fluid and another fluid or body.

The vapor compression circuit operates according to a conventional gas compression cycle. The cycle comprises. the change in state of the heat-transfer fluid from a liquid (or liquid/gas two-phase) phase to a gas phase at a relatively low pressure, then the compression of the fluid in the gas phase up to a relatively high pressure, the change in state (condensation) of the heat-transfer fluid from the gas phase to the liquid phase at a relatively high pressure, and the reduction of the pressure to restart the cycle.

According to a particularly preferred embodiment, the lubricating composition according to the invention is intended for an air conditioning device, and more particularly for an automobile air conditioning device.

Preferably, it is intended for an automobile air conditioning compressor, in particular for a wobble plate compressor or an electric scroll compressor.

Thus, according to yet another of its aspects, the invention relates to a compressor of an automobile air conditioning system employing a. lubricating composition according to the invention.

The compressor can be driven by an electric motor or heat engine or by a gas turbine (for example, powered by the exhaust gases of a vehicle), or by gearing.

The invention will now be described by means of the following example, given by way of illustration and without limitation of the invention.

EXAMPLES

Example 1

Preparation of a Lubricating Composition According to the Invention

A lubricating composition in accordance with the invention was prepared by simple mixing, at ambient temperature, of the following components, in the proportions by weight shown in the following table 1.

TABLE 1

| Component | Lubricating formula (% by weight) |
|---|---|
| PAG A | 91.7 |
| PAG B | 8 |
| Antioxidant | 0.2 |
| Antiwear | 0.1 |

The PAG A employed is a propylene oxide/ethylene oxide copolymer, formed to more than 97% by weight of propylene oxide (KV100=7.98 $mm^2/s$, KV40=39.95 $mm^2/s$, hydroxyl number (ASTM E1899-08)=61.4 mg KOH/g).

The PAG B is a copolymer of propylene oxide and of ethylene oxide (PO/EO 4/6 by weight) (KV100=178 $mm^2/s$, KV40=1050 $mm^2/s$, hydroxyl number=59.6 mg KOH/g).

The antioxidant is a phenolic compound.

The antiwear/extreme pressure agent is an amine phosphate.

The characteristics of the composition thus prepared are presented in the following table 2.

TABLE 2

| Characteristic | Measurement standard | |
|---|---|---|
| KV40 ($mm^2/s$) | ISO 3104 (ASTM D445) | 49.65 |
| KV100 ($mm^2/s$) | ISO 3104 (ASTM D445) | 9.82 |
| Acid number (mg KOH/g) | ISO 6618 | 0.08 |

Example 2

Evaluation of the Thermal Stability Properties in the Presence of the Coolant HFO-1234yf Two lubricating compositions were evaluated:

a lubricating composition 11 in accordance with the invention, combining a PAG A in accordance with the invention, denoted PAG $A^{(1)}$, exhibiting the following properties: hydroxyl number=57 mg KOH/g; KV40=39.96 $mm^2/s$; KV100=7.97 $mm^2/s$; and a PAG B according to the invention exhibiting the following properties: KV40=1000 $mm^2/s$ and KV100=178.0 $mm^2/s$; and a commercial lubricating composition C1 comprising a PAG A in accordance with the invention, denoted PAG $A^{(2)}$, exhibiting the following properties: hydroxyl number=55 mg KOH/g; KV40=39.96 $mm^2/s$ KV100=7.97 $mm^2/s$, but devoid of PAG B.

The two types of polyalkylene glycol used in the context of the present examples are:

PAG $A^{(1)}$ and PAG $A^{(2)}$: polyalkylene glycols formed of at least 96% by weight of oxypropylene units; the ends of which are uncapped, and synthesized from the initiator methanol, for example sold under the Konlube® RF 240 YF reference.

PAG B: random copolymer of ethylene oxide (60% by weight) and of propylene oxide (40% by weight), synthesized from an initiator of diol type, for example sold under the Synalox® 40D700 reference.

The compositions and the amounts (expressed as percentage by weight) are shown in the following table 3.

TABLE 3

| Lubricating composition | I1 | C1 |
|---|---|---|
| PAG $A^{(1)}$ | 96.7 | — |
| | — | 99.6 |
| PAG B | 3 | |
| Phenolic antioxidant | 0.2 | 0.2 |
| Phosphorus-containing antiwear | 0.1 | 0.2 |

Evaluation of the Thermal Stability

The thermal stability tests are carried out according to the standard ASHRAE 97-2007: "Sealed Glass Tube Method to Test the Chemical Stability of Materials for use within Refrigerant Systems".

More particularly, the lubricant/coolant HFO-1234yf) (ratio by weight 1:1) systems, and metal lengths (Al, Cu and Fe (steel)) as catalyst materials, are introduced into glass tubes. The tubes are closed and placed in a stainless steel autoclave at 175° C. for 336 hours. The target pressure at 175° C. is 35 bar.

The lubricants are tested as is ("1) Aging without water") and by adding water so as to reach 2000 ppm of water ("2) Aging with 2000 ppm of water").

The viscosity of the lubricant is determined, before and after aging, according to the standard DIN 51562-1 using a Ubbelohde viscometer. The variation in viscosity for each of the lubricating compositions tested is given in the following table 4.

Results

The characteristics of the lubricating compositions tested, as well as the results of the thermal stability test in the presence of the coolant HFO-1234yf, are shown in the following table 4.

TABLE 4

| | Measurement standard | Unit | I1 | C1 |
|---|---|---|---|---|
| Characteristics | | | | |
| KV40 | ISO 3104 | $mm^2/s$ | 47.54 | 39.96 |
| KV100 | ISO 6618 | $mm^2/s$ | 9.377 | 7.97 |
| Hydroxyl number | ASTM D 3233 | mg KOH/g | 57 | 55 |
| Water content | ISO 12937 | % | 0.063 | <0.002 |
| Thermal stability test in the presence of HFO-1234yf | | | | |
| 1) Aging without water Viscosity variation | Ashrae standard 97 | % | 0.4 | 6 |
| 2) Aging with 2000 ppm of water Viscosity variation | | % | 0.2 | 6 |

The variations in viscosity measured on conclusion of the aging tests are markedly lower for the lubricating composition 11 in accordance with the invention, in comparison with the commercial composition C1.

The lubricating composition according to the invention, combining a PAG A and a PAG B according to the invention, thus exhibits improved properties in terms of thermal stability, in comparison with the commercial composition C1 not comprising PAG B.

The invention claimed is:

1. A lubricating composition for a refrigerant system comprising a gas compression circuit, the lubricating composition comprising:

(a) at least one first polyalkylene glycol A (PAG A) having a hydroxyl number greater than 50 mg KOH/g, and a kinematic viscosity, measured at 100° C. according to the standard ASTM D445, ranging from 5 to 10 $mm^2/s$; and (b) at least one second polyalkylene glycol B (PAG B), having a kinematic viscosity, measured at 100° C. according to the standard ASTM D445, ranging from 100 to 500 $mm^2/s$, wherein polyalkylene glycols A and B are present in the lubricating composition in a weight ratio of PAG A:PAG B ranging from 60/40 to 99/1.

2. The lubricating composition according to claim 1, wherein PAG A has a kinematic viscosity ranging from 6 to 9 $mm^2/s$.

3. The lubricating composition according to claim 1, wherein PAG A comprises at least one oxypropylene unit.

4. The lubricating composition according to claim 1, wherein PAG A is a copolymer of propylene oxide and of ethylene oxide.

5. The lubricating composition according to claim 1, wherein PAG A exhibits just one of its hydroxyl ends capped by an alkyl group comprising from 1 to 10 carbon atoms, and optionally comprising one or more heteroatoms, or with a fluoroalkyl group optionally containing heteroatoms.

6. The lubricating composition according to claim 1, wherein the total amount of PAG A in the lubricating composition ranges from 60% to 99% by weight, relative to the total weight of the lubricating composition.

7. The lubricating composition according to claim 1, wherein PAG B has a kinematic viscosity ranging from 120 to 300 $mm^2/s$.

8. The lubricating composition according to claim 1, wherein PAG B is a copolymer of propylene oxide and of ethylene oxide.

9. The lubricating composition according to claim 1, wherein the total amount of PAG B in the lubricating composition ranges from 1% to 30% by weight, relative to the total weight of the lubricating composition.

10. The lubricating composition according to claim 1, wherein the total amount of polyalkylene glycols A and B in the lubricating composition is greater than 70% by weight, relative to the total weight of the lubricating composition.

11. The lubricating composition according to claim 1, wherein the composition further comprises at least one antiwear/extreme pressure additive of amine phosphate type.

12. The lubricating composition according to claim 1, said wherein the composition further comprises at least one phenolic antioxidant additive.

13. The lubricating composition according to claim 1, comprising:

(a) from 75% to 99% by weight of PAG A;

(b) from 1% to 15% by weight of PAG B;

(c) optionally, from 0.001% to 1% by weight of at least one antiwear/extreme pressure additive of amine phosphate type; and (d) optionally, from 0.05% to 3% by weight of at least one phenolic antioxidant;

wherein the sum of (a)-(d) is equal to 100%, and the percentages are by weight, relative to the total weight of the lubricating composition.

14. A lubricating method of a refrigerant system comprising a gas compression circuit and using a coolant based on hydrofluorocarbon compounds, comprising a step of implementing a lubricating composition according to claim 1.

15. A compressor of an automobile air conditioning system employing a lubricating composition according to claim 1.

16. A heat-transfer composition for a refrigerant system comprising a gas compression circuit, comprising:

a lubricating composition as defined in claim 1; and a coolant based on hydrofluorocarbon compounds.

17. A refrigerating method of a refrigerant system comprising a gas compression circuit, said method comprising implementing a heat-transfer composition according to claim 16.

18. A refrigerant system comprising a gas compression circuit, said refrigerant system comprising a heat-transfer composition according to claim 16.

19. The lubricating composition according to claim 1, wherein the total amount of PAG A in the lubricating composition ranges from 85% to 95% by weight, relative to the total weight of the lubricating composition.

20. The lubricating composition according to claim 1, wherein the total amount of PAG B in the lubricating composition ranges from 3% to 10% by weight, relative to the total weight of the lubricating composition.

* * * * *